US006089405A

United States Patent [19]

Schmitt

[11] Patent Number: 6,089,405

[45] Date of Patent: Jul. 18, 2000

[54] CREAM OR PASTE DISPENSER

[76] Inventor: Rolf-Peter Schmitt, Feincheswiese, 56424 Staudt, Germany

[21] Appl. No.: 09/301,053

[22] Filed: Apr. 28, 1999

[30] Foreign Application Priority Data

Apr. 29, 1998 [DE] Germany ..... 298 07 698

[51] Int. Cl.[7] ..... B65D 35/28

[52] U.S. Cl. ..... 222/102; 222/105

[58] Field of Search ..... 222/102, 105

[56] References Cited

U.S. PATENT DOCUMENTS

| | | | |
|---|---|---|---|
| 2,876,934 | 3/1959 | Brim | 222/102 |
| 2,901,147 | 8/1959 | Bond, Jr. | 222/102 |
| 3,257,039 | 6/1966 | Trutza | 222/102 |
| 3,297,205 | 1/1967 | Sumner | 222/102 |
| 5,050,773 | 9/1991 | Choi | 222/102 X |
| 5,277,335 | 1/1994 | Okami et al. | 222/102 |

*Primary Examiner*—Kevin Shaver
*Assistant Examiner*—Eric Keasel
*Attorney, Agent, or Firm*—Friedrich Kueffner

[57] ABSTRACT

A device for holding a tube containing cream or paste and for the dosed or proportioned dispensing of cream or paste, wherein the device is composed of a housing holding the tube. The housing includes a support plate with an opening engaging around the outlet end of the tube, two pressing rollers with gear wheels which can be placed in engagement with the end of the tube and can be moved along the tube through a rack and a guide device, wherein the pressing rollers rest against the tube under initial tension and are rotatable from the outside.

9 Claims, 1 Drawing Sheet

CREAM OR PASTE DISPENSER

BACKGROUND OF THE INVENTION

1. Field of the Invention

The present invention relates to a device for holding a tube containing cream or paste and for the dosed or proportioned dispensing of cream or paste, wherein the device is composed of a housing holding the tube.

2. Description of the Related Art

Creams or pastes, particularly toothpastes, are filled and stored in tubes of deformable material. The storage usually occurs with the tube placed horizontally or vertically in a special cabinet which is, in most cases, hung up in a bathroom. When toothpaste is removed from the tube, a closing cap screwed onto the outlet end of the tube is removed and the required amount of toothpaste is pressed out by slightly pressing the tube between two fingers. However, when the tube is pressed unintentionally too strongly, more than the required toothpaste flows out, which leads to unnecessary loss of toothpaste. This is particularly the case when children press the toothpaste out of the tube. When the closing cap is opened, it frequently happens that the cap falls on the ground and it is then difficult to find the cap. Also, toothpaste may be lost when the closing cap is not screwed on correctly.

SUMMARY OF THE INVENTION

Therefore, it is the primary object of the present invention to provide a device for holding a tube for cream or paste and for the dosed or proportioned dispensing of creams or pastes in which the cumbersome removal and screwing-on of the closing cap are avoided and in which it is essentially impossible that more than the required amount of cream or paste, particularly toothpaste, flows out of the tube.

In accordance with the present invention, in a device of the above-described type, the housing includes a support plate with an opening engaging around the outlet end of the tube, two pressing rollers with gear wheels which can be placed in engagement with the end of the tube and can be moved along the tube through a rack and a guide means, wherein the pressing rollers rest against the tube under initial tension and are rotatable from the outside.

In a device constructed in accordance with the present invention, the tube does not have to be continuously opened and closed. It is no longer necessary to search for the closing cap. The tube is securely stored and the quantity of paste to be dispensed can be dosed or proportioned very well by rotating the pressing rollers.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
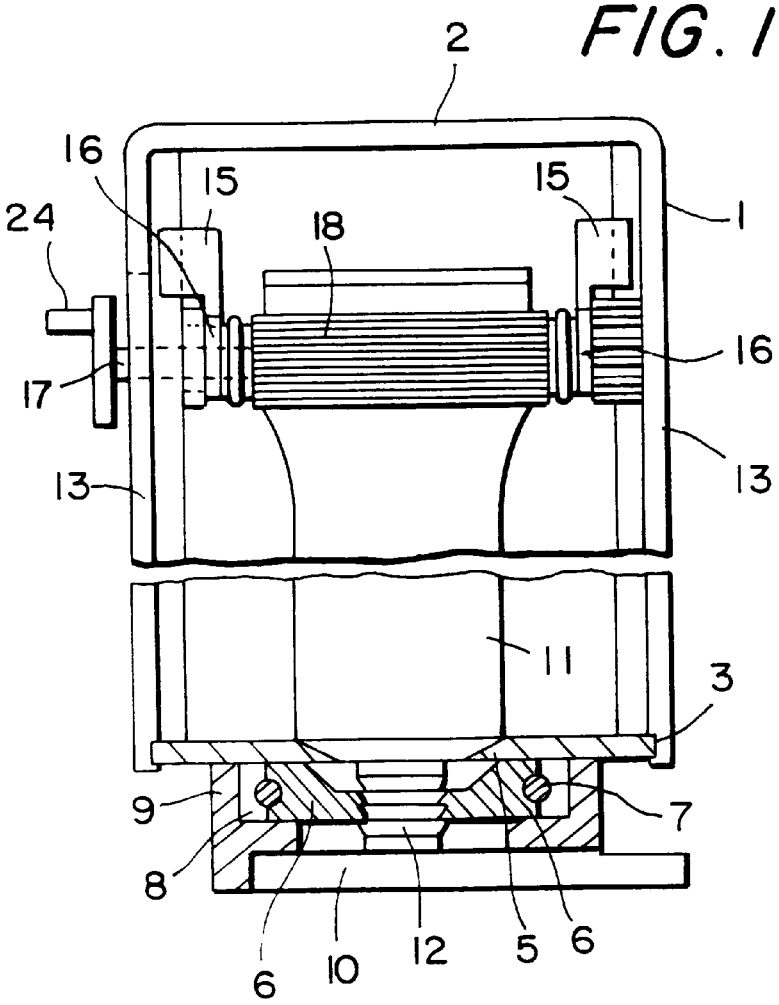
FIG. 1 is an elevational view of a device according to the present invention.
Figure 2:
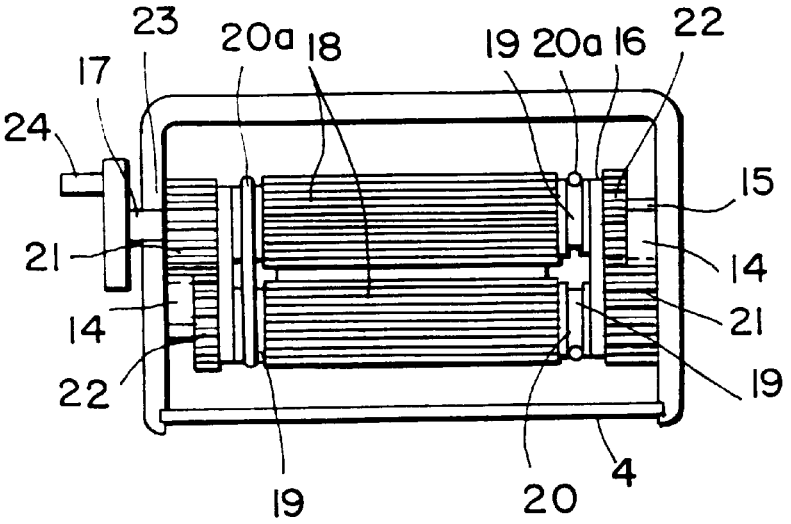
FIG. 2 is a top view of the device of FIG. 1.

FIGS. 1 and 2 of the drawing show a device 1 which serves to hold a toothpaste tube and to dispense toothpaste in a dosed or proportioned manner. The device 1 includes a housing 2, for example, of synthetic material, which, in the illustrated embodiment, has a parallepiped shape and is closed at the bottom by an insertable bottom 3 constructed as a support plate and at the front by a transparent plate 4 which can also be inserted. The bottom 3 is provided with an opening 5 and has on its bottom side two resiliently mounted clamping jaws 6 which are configured as half-shells and which, in the illustrated embodiment, are held together or are clamped together by a slightly pretensioned O-ring 7. The two clamping jaws 6 are slidably guided in a chamber 8 which is defined by a sleeve 9 which is partially closed at the bottom. A closing plate 10 is pivotally mounted at this sleeve 9. The opening 5 in the bottom 3 and the two clamping jaws 6 are adapted to fit together with the tube 11 filled with toothpaste, such that the outlet end 12 of the tube 11 is resiliently received by the clamping jaws 6, as illustrated in FIG. 1 of the drawing. In this position, the outlet 12 is closed by the plate 10.

A rack 14 each is provided at the inner surfaces of the two side parts 13 of the housing 2. The racks 14 are arranged offset relative to each other, extend perpendicularly toward the bottom 3 and simultaneously serve to act as a guide means. Guided at each of these racks 14 is the upper portion of a carriage 15, which, in the illustrated embodiment, is constructed of a single piece, for example, of synthetic material. If necessary, particularly for manufacturing reasons, this carriage 15 may also be composed of two parts. Each carriage 15 has an upper portion surrounding the rack 14 and a lower plate-shaped portion 16 which has two bores, not shown, for receiving pins 17, wherein always one pin 17 is illustrated in FIGS. 1 and 2 of the drawing. The bores advantageously are constructed as oblong holes which extend in a roof-like configuration relative to each other.

The pins 17 are provided at both ends of the pressing rollers 18 and serve to secure the rotation of the rollers 18. In accordance with an advantageous feature, the surface of each pressing roller 18 is corrugated. A loosely rotatable disk 19, for example, of synthetic material, is mounted on each pin 17 between the plate-shaped portion 16 of the carriage 16 and the pressing rollers 18. This disk 19 is provided with a circumferential groove 20. A pretensioned O-ring **20*a* is placed in each circumferential groove 20 of the two oppositely located disks 19 of the adjacent pressing rollers 18. The pretensioned O-rings 20*a* cause the two pressing rollers 18 to always have the tendency to move toward each other as much as possible. This means that when the pressing rollers 18 are rolled onto the tube 11, the pressing rollers 18 are moved apart from each other by a predetermined distance as can be seen in FIG. 2 of the drawing. The bores constructed as obliquely extending oblong holes in the plate-shaped portions 16** permit this movement.

Each pressing roller 18 has on one of its pins 17 a gear wheel 21 which is relatively wide and meshes with a rack 14. This wide gear wheel 21 additionally engages in a narrow gear wheel 22 which is attached on the pin 17 of the oppositely located pressing roller 18. The gear wheels 21 and 22 are attached so as to rotate with the pins 17 which support the gear wheels. A pin 17 protrudes through a slot 23 which is formed perpendicularly in a side wall 13 of the housing 2. In the illustrated embodiment, this pin 17 has at its free end a crank 24; a conventional ratchet may also be provided instead of the crank 24. By rotating the crank 24, the pressing rollers 18 move downwardly on the tube 11. When the closing plate 10 is swung back, toothpaste is now pressed out through the outlet end 12. The crank 24 is always rotated by only a relatively small extent which corresponds to the volume of toothpaste to be pressed out of the tube 11. When a ratchet is used, the quantity may correspond to a tooth.

When the two pressing rollers 18 have reached their lowermost position on the tube 11, the tube 11 is almost completely empty. The pressing rollers 18 are then moved by means of the crank 24 back into the initial position in which the tube 11 is released and can be removed. A new tube 11 is then placed in the housing 2 of the device 1.

The device described above can advantageously be attached to a wall either directly by means of a screw or through a ledge or strip. When a ledge or strip is used, it may additionally support housings constructed as rotatable brush holders, holders for paper napkins and cotton pads, or as elements with drawers or shelves.

While specific embodiments of the invention have been shown and described in detail to illustrate the inventive principles, it will be understood that the invention may be embodied otherwise without departing from such principles.

I claim:

1. A device for holding a tube containing cream or paste and for a dosed dispensing of cream or paste, the device comprising a housing with a support plate having an opening adapted to surround an outlet end of the tube, two pressing rollers with gear wheels in engagement with a rack and a guide means at each end of the rollers, wherein the pressing rollers are in engagement with the end of the tube and are movable along the tube, further comprising means for pretensioning the pressing rollers against the tube and means extending out of the housing for rotating the pressing rollers.

2. The device according to claim 1, wherein the pressing rollers are each mounted at both ends thereof in a carriage secured in the guide means.

3. The device according to claim 1, wherein the means for rotating the pressing rollers is comprised of a shaft extending from one of the pressing rollers through a slot of the housing and an actuating element mounted on the shaft.

4. The device according to claim 3, wherein the actuating element is a turning handle.

5. The device according to claim 2, wherein each carriage has oblong holes extending obliquely outwardly and downwardly for receiving shafts of the pressing rollers.

6. The device according to claim 1, wherein the opening surrounding the outlet end of the tube is formed by two resiliently mounted clamping jaws.

7. The device according to claim 6, wherein a pivotable closing plate is mounted underneath the opening.

8. The device according to claim 1, further comprising a cover for closing the housing.

9. The device according to claim 1, further comprising a support rail, wherein the housing and additional housings are mounted on the support rail.

* * * * *